US005329671A

United States Patent [19]

Walczak et al.

[11] Patent Number: 5,329,671

[45] Date of Patent: Jul. 19, 1994

[54] BEVELED EDGE STRAPPING

[75] Inventors: William A. Walczak, Schererville, Ind.; Ronald F. DeSimone, Orland Park, Ill.

[73] Assignee: Acme Packaging Corporation, Riverdale, Ill.

[21] Appl. No.: 33,367

[22] Filed: Mar. 18, 1993

[51] Int. Cl.[5] ..... B65D 63/00

[52] U.S. Cl. ..... 24/20 R; 24/16 R; 24/20 EE

[58] Field of Search ..... 24/20 R, 20 EE, 20 S, 24/16 R, 17 R, 30.5 P, 30.5 R; 285/37, 293

[56] References Cited

U.S. PATENT DOCUMENTS

| | | | |
|---|---|---|---|
| 386,439 | 7/1888 | Sovereign | 24/20 EE |
| 1,828,186 | 10/1931 | Harvey | 24/20 R |
| 2,751,651 | 6/1956 | Cooper | 24/20 R |
| 3,235,071 | 2/1966 | Simich et al. | 24/20 R |
| 3,303,669 | 2/1967 | Oetiker | 24/20 R |
| 3,602,533 | 8/1971 | Starr | 24/20 R |
| 5,103,534 | 4/1992 | Caveney | 24/20 R |

*Primary Examiner*—Victor N. Sakran

*Attorney, Agent, or Firm*—Hill, Steadman & Simpson

[57] ABSTRACT

An improved metal strapping which has tapered ends such that the sharp corners of conventional strapping do not bite in or mar the product being bound by the strapping. The ends can be tapered over a range of 20°–40° with the planar surface of the strapping.

6 Claims, 1 Drawing Sheet

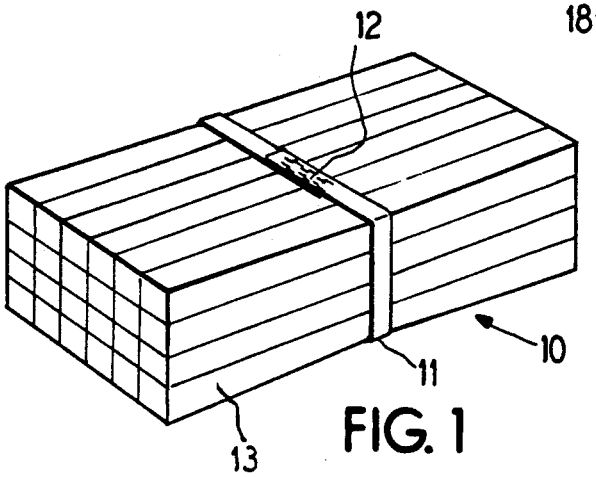
FIG. 1
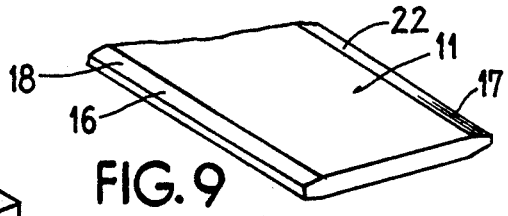
FIG. 9
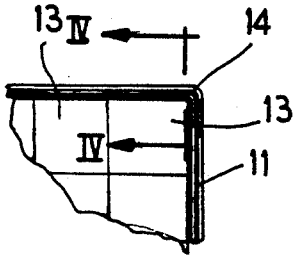
FIG. 2
FIG. 4
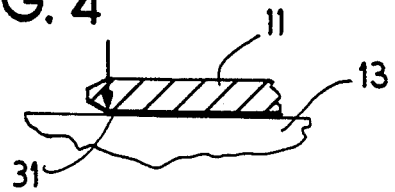
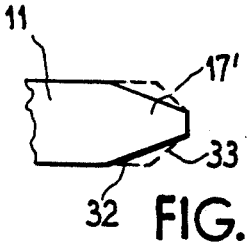
FIG. 6
FIG. 3
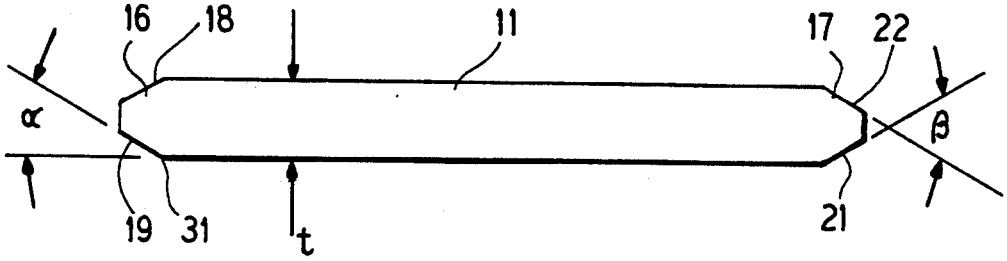
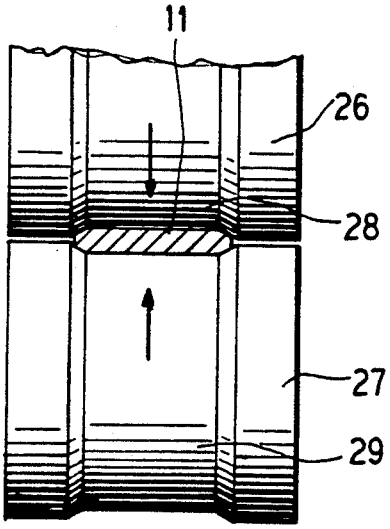
FIG. 5
FIG. 7
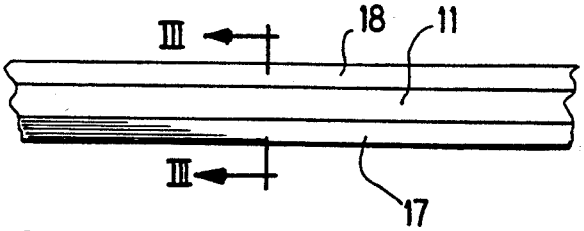
FIG. 8
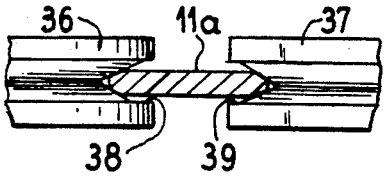

BEVELED EDGE STRAPPING

BACKGROUND OF THE INVENTION

1. Field of the Invention

This invention relates in general to a novel strapping for packaging and in particular to a strap which has beveled edges.

2. Description of Related Art

Metal strapping has been used for many years for packaging many items such as steel, wood, plastic cardboard and other items. Strapping is placed about the goods and at the ends of the strapping are joined or sealed while under tension so as to hold the items together. For example, strapping is used to hold steel rods or pipes and conventional strapping is formed with sharp corners or edges and when used can cut in and mar the surface of the pipe or steel rods, thus, weakening the item where it is marred by the strapping. One Japanese company may have deburred strapping with an angle of 10 degrees, but this does not give the advantages of the invention which is more effective in application.

SUMMARY OF THE INVENTION

It is an object of the present invention to provide a novel strapping with beveled edges which prevent sharp corners of the strapping from cutting into and marring the items being strapped.

It is a feature of the present invention that the two side edges of the strap are formed so that they are tapered so that the items being bound by the strap will not be marred or cut by the sharp edges of the strap. Since the ends or edges of the strap are tapered, the sharp corners of the conventional strapping are eliminated and the tapered edges of the strap do not mar or cut into the items being bound by the strapping. Rod stock which has been cut by prior art strapping will break at the cut point when extruded.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure, and in which:

BRIEF DESCRIPTION OF THE DRAWINGS

FIG. 1 illustrates the strapping of the invention in use about a number of items such as steel bars;

FIG. 2 is a partially cut-away sectional view of the strap 11 as it passes over a corner of one of the bars shown in FIG. 1;

FIG. 3 is a sectional view through the strapping taken on line III—III from FIG. 7.

FIG. 4 is an enlarged sectional view illustrating strapping on an item;

FIG. 5 is a partially cut-away view illustrating a pair of forming rolls for forming the novel strapping of the invention;

FIG. 6 is an enlarged view showing variations in the taper angle;

FIG. 7 is a plan view illustrating the strapping of the invention;

FIG. 8 illustrates another method of forming the invention; and

FIG. 9 is a perspective view illustrating the strapping of the invention.

DETAILED DESCRIPTION OF THE PREFERRED EMBODIMENTS

FIG. 1 is a perspective view illustrating a package 10 formed by surrounding a plurality of items such as steel bar stock 13 with the novel strapping 11 of the invention. The strapping 11 is placed around a number of the bars 13 and joined with a seal 12 to form the package 10.

The novel strapping of the invention is formed to have beveled edges such as illustrated in FIGS. 3, 4, 5, 6 and 7.

As best shown in FIG. 3, the strapping 11 has a thickness t and its side edges 16 and 17 are formed so as to be tapered. For example, the end 16 is formed by tapered surfaces 18 and 19 and the surface 19 is tapered so that it makes an angle $\alpha$ of about 30° with the planar surface of the strapping 11 as illustrated. Likewise, the surface 18 makes an angle of $\alpha$ with the top surface of the strapping 11. The surfaces 21 and 22 at the end 17 are also tapered so that they make an angle $\alpha$ with the lower and upper surfaces of the strapping and have an included angle $\beta$ of about 60°.

As shown in FIG. 4, when the strapping 11 is placed about items 13 which are to be bound and the strapping is tensioned and sealed, the stress at point 31 at the junction between the lower surface of the strapping 11 and the tapered surface 19 will be substantially less than it would be if the ends 16 and 17 were not tapered.

FIG. 5 illustrates the manner in which the strapping 11 is formed by rollers 26 and 27 which have contours 28 and 29 such that as the strapping 11 is rolled between the rollers 26 and 27, the surfaces 18, 19, 21 and 22 are formed as shown in FIG. 5.

The strapping 11 may be made of steel such as regular duty low carbon steel or mid-carbon quick cooled steel or high duty heat treated high carbon steel. The thickness "f" of the strapping may be in the range of about 15 to 57 thousandths of an inch thick.

Strapping with angle $\alpha$ of about 30° has proved very satisfactory in use, but as shown in FIG. 6, the ends such as the ends 17' may be tapered over a range of 20°–40° . The surface 32 in FIG. 6 has a taper relative to the plane of the bottom surface of 20° and the dashed line surface 33 has an angle of 40° relative to the plane of the bottom surface of the strapping. Thus, the angle $\alpha$ may vary over a range from 20°–40° on the top and bottom edges of the strapping.

FIG. 7 is a plan view of the strapping 11.

FIG. 8 shows a pair of rollers 36 and 37 between which the strapping **11*a* is passed so that the tapered grooves 38 and 39** form a taper on the edges of the strapping.

FIG. 9 is a perspective view of the strapping 11 of the invention.

It is seen that the present invention provides an improved strapping which does not mar or bite into products being held by the strapping, and although it has been described with respect to preferred embodiments, it is not to be so limited as changes and modifications can be made therein which are within the full intended scope as defined by the appended claims.

We claim as our invention:

1. Metal strapping for packaging items such as steel pipe, bars and other items comprising, metal strapping with first and second planar surfaces which can be placed about the items and joined and wherein at least the side edges of said metal strapping adjacent the first planar surface are tapered so that the tapered surfaces make an angle in the range of 20 to 40 degrees with said first planar surface and the edges tend to form a point which is thinner than said metal strapping whereby said tapered side edges will not cut-in and injure the packaged material.

2. Metal strapping for packaging items according to claim 1 wherein said tapered surfaces make an angle in the range of 25 to 35 degrees with said first planar surface.

3. Metal strapping for packaging items according to claim 1 wherein said tapered surfaces make an angle of about 30 degrees with said first planar surface.

4. Metal strapping for packaging according to claim 1 wherein the side edges of said strapping adjacent said second planar surface are tapered so that the tapered surfaces make an angle in the range of 20 to 40 degrees with said second planar surface.

5. Metal strapping for packaging according to claim 1 wherein the side edges of said strapping adjacent said second planar surface are tapered so that the tapered surfaces make an angle in the range of 25 to 35 degrees with said second planar surface.

6. Metal strapping for packaging according to claim 1 wherein the said edges of said strapping adjacent said second planar surface are tapered so that the tapered surfaces make an angle of about 30 degrees with said second planar surfaces.

* * * * *